US011118331B2

(12) United States Patent
Li

(10) Patent No.: US 11,118,331 B2
(45) Date of Patent: Sep. 14, 2021

(54) IN-WALL VALVE BODY FOR SHOWER OR BATHTUB

(71) Applicant: DeChang Li, Maspeth, NY (US)

(72) Inventor: DeChang Li, Maspeth, NY (US)

(73) Assignee: Compass Manufacturing International, LLC, Louisville, KY (US)

( * ) Notice: Subject to any disclaimer, the term of this patent is extended or adjusted under 35 U.S.C. 154(b) by 0 days.

(21) Appl. No.: 16/102,599

(22) Filed: Aug. 13, 2018

(65) Prior Publication Data

US 2019/0085539 A1 Mar. 21, 2019

Related U.S. Application Data

(60) Provisional application No. 62/544,322, filed on Aug. 11, 2017.

(51) Int. Cl.
*E03C 1/042* (2006.01)
*E03C 1/02* (2006.01)

(52) U.S. Cl.
CPC ..... *E03C 1/042* (2013.01); *E03C 1/021* (2013.01)

(58) Field of Classification Search
CPC ..... E03C 1/021; E03C 1/042
See application file for complete search history.

(56) References Cited

U.S. PATENT DOCUMENTS 4,896,381 A * 1/1990 Hutto ..... E03C 1/042 137/359
4,979,538 A * 12/1990 Krippendorf ..... E03C 1/042 137/359
6,038,715 A * 3/2000 Flieger ..... A47K 3/283 4/601
6,209,926 B1 * 4/2001 Mastro ..... E03B 7/09 285/148.19
6,880,565 B2 * 4/2005 Ouyoung ..... E03C 1/0408 137/100
8,459,287 B1 * 6/2013 Preudhomme ..... F16L 19/065 137/15.08
10,829,915 B2 * 11/2020 Bai ..... E03C 1/042
2003/0192116 A1 * 10/2003 Burger ..... E03C 1/023 4/695
2006/0231140 A1 * 10/2006 McNerney ..... E03C 1/021 137/360

(Continued)

*Primary Examiner* — Kevin F Murphy
*Assistant Examiner* — Jonathan J Waddy
(74) *Attorney, Agent, or Firm* — Carrithers Law Office, PLLC

(57) ABSTRACT

A valve body for a shower, a bathtub, or a shower-bathtub installations. The valve body includes nipples for direct connection to PEX water supply lines and the shower head outlet, a bathtub faucet tapered nipple which is a universal outlet with male NPT threads to which a copper line can either be threaded, soldered or a slip or friction fit with a hose retainer clip and hot and cold adjustable limiters and standoffs on the rear side for installation of the valve body to a backer board. The standoff lug spacer means provide for precise spacing of the plumbing connections within the wall with respect to the front surface of the wall board. The standoffs also provide clearance between the plumbing connections and the backer board. The valve body accepts various back to back functional type pressure balanced cartridges for control of water flow through the faucet.

15 Claims, 4 Drawing Sheets

(56) References Cited

U.S. PATENT DOCUMENTS

| | | | | |
|---|---|---|---|---|
| 2009/0057591 | A1* | 3/2009 | Izzy | E03C 1/021<br>251/288 |
| 2012/0145258 | A1* | 6/2012 | Yang | E03C 1/042<br>137/359 |
| 2015/0191900 | A1* | 7/2015 | Johnson | E03C 1/023<br>137/625.19 |
| 2017/0059053 | A1* | 3/2017 | Aykens | E03C 1/021 |

* cited by examiner

IN-WALL VALVE BODY FOR SHOWER OR BATHTUB

CROSS REFERENCES TO RELATED APPLICATIONS

This application claims priority from U.S. Provisional Application Ser. No. 62/544,322 filed on Aug. 11, 2017 and is incorporated by reference in its entirety.

TECHNICAL FIELD

The present invention relates to the field of in wall water valves used for hot and cold water delivery to a shower head or bathtub.

BACKGROUND OF THE INVENTION

All homes, apartment complexes, gymnasiums and factories, any facilities with bathtubs or showers have plumbing fixtures for the delivery of hot, cold and warm water to users of these bathtubs and showers. Older installations have separate hot and cold water valves whereby the user selects the water temperature by balancing the two valves and thus, the two water flows together to attain the proper temperature of combined water flow. In the installations where a user may choose the fill a tub or take a shower, there must be a knob to pull or a valve to turn to select tub fill or shower flow.

In most installations today, a valve is used which has one single handle and this handle is used to select water temperature and amount of flow. The valve body in such a single handle valve includes inlet connections for a hot water supply line, a cold water supply line, and outlet connections for a bathtub faucet and for a shower head. The valve body accepts differing styles of control pressure balanced cartridges which are used to manually control the water temperature and flow through the valve and to send the water out through the shower head or the bathtub faucet. Some valve bodies also include adjustable flow limiters on the hot and cold supply inputs.

SUMMARY OF THE INVENTION

An in-wall valve assembly for a combination shower and bathtub comprising or consisting of a valve body including a tapered nipple for a hot water line and a tapered nipple for a cold water line, and a tapered nipple for a shower output and a tapered output nipple for cooperative engagement with respective water lines. The valve body includes an adjustable flow limiter for a hot water input and a cold water input. The valve body also includes a first water controlling cartridge receiving aperture formed therein with external threads and a cartridge locknut capable of sealing fixing a water controlling cartridge in place within the first aperture. The valve body includes spacer means defining a plurality of spaced apart opposing standoff lugs of a selected area and equal thickness on a rear surface for providing for proper positioning of the valve body with respect to a board installed between studs in a wall. The valve body includes a first pair of lugs having threaded apertures for holding a removable housing on the valve body, the removable housing meant to be discarded after installation of the valve body. The valve body has a second pair of lugs having apertures formed therein for insertion of fasteners for attaching the valve body to a board. Moreover, the valve body includes a temporary, removable pressure test plug which is held in place by a cartridge locknut for temporarily sealing of a valve output during temporary pressure testing of an installed water supply line to the valve body.

Moreover, in accordance with the present invention, there is provided a valve body kit for a combination shower and bathtub comprising, consisting of, or consisting essentially of a valve body including tapered nipples for PEX (cross-linked polyethylene), type hot and cold supply lines, a tapered nipple for PEX type line for shower output and a tapered output nipple with male NPT (national pipe threads), to which a one half inch copper line may be threaded or sweated thereto. The valve body kit includes adjustable flow limiters for hot and cold inputs, and has a first water controlling cartridge receiving aperture formed therein with external threads and a cartridge locknut capable of sealing a water controlling cartridge in place within the first aperture. The valve body includes a plurality of spacer means such as standoffs on a rear side thereof for providing for proper positioning of the valve body with respect to a board installed between two internal studs in a bathroom wall. The valve body includes two first lugs having second threaded apertures therein for holding a temporary protective housing (plaster guard) on the valve body where the protective housing is meant to be discarded after the body is installed. The valve body has two second lugs with third apertures formed therein for insertion of fasteners for fixing the valve body to a board. The valve body includes a temporary, removable pressure test plug which is held in place by a cartridge locknut for temporarily sealing of valve outputs during temporary pressure testing of installed water supply lines to the valve body. Finally, the valve body includes a temporary protective housing covering a front side of the valve body and covering the cartridge locking nut and the removable pressure test plug.

It is an object of this invention to provide a valve body for a shower-bathtub combination which includes nipples for PEX type hot and cold supply lines, a nipple for PEX type line for shower output and an output with Male NPT threads to which a one half inch copper line may be threaded or sweated thereto.

It is an object of this invention to provide a valve body for a shower-bathtub combination which includes adjustable flow limiters for the hot and cold inputs.

It is an object of the present invention to provide novel tapered nipples for connecting the water lines thereto eliminating the need for adapters.

It is an object of this invention to provide a valve body for a shower-bathtub combination which includes a cartridge receiving aperture with external threads and a cartridge locknut capable of receiving a water controlling cartridge.

It is an object of this invention to provide a valve body for a shower-bathtub combination which includes a plurality of spacer means or standoffs on the rear side of the valve body to provide for proper positioning of the valve body with respect to a board installed between two internal studs in a bathroom wall.

It is an object of this invention to provide a valve body for a shower-bathtub combination which includes two lugs with threaded apertures for holding a temporary protective housing on the valve body which is meant to be discarded after the body is installed.

It is an object of this invention to provide a valve body for a shower-bathtub combination which includes two lugs with apertures for insertion of screws or other fasteners for fixing the valve body to a board.

It is an object of this invention to provide a valve body for a shower-bathtub combination which includes a temporary, removable pressure test plug which is held in place by a cartridge locknut and closes the valve outputs for temporary pressure testing of the installation of the water supply lines to the valve body.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
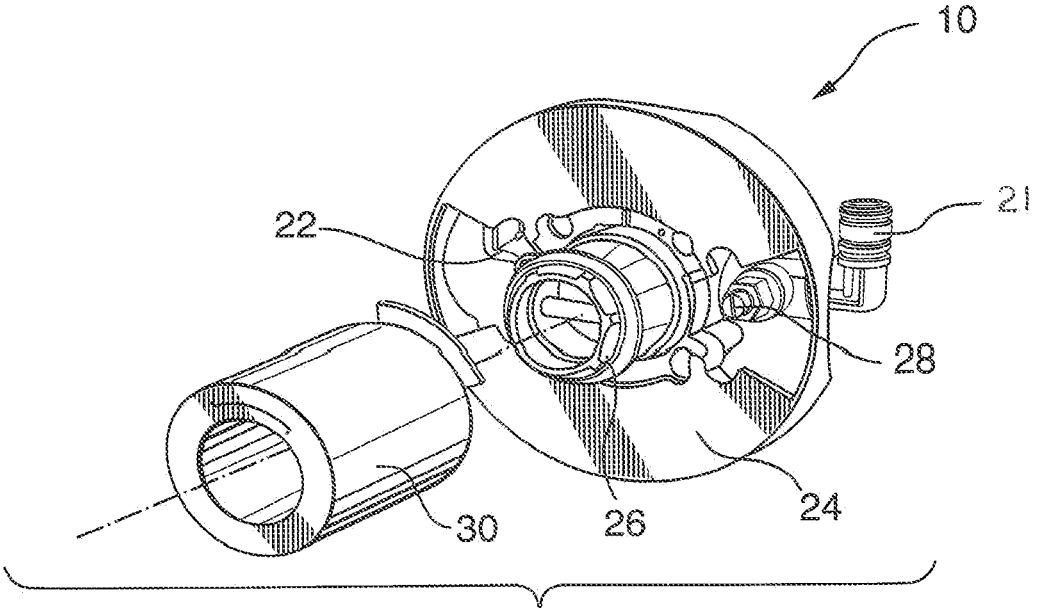
FIG. 1 is a front view of the valve body.

In accordance with the present invention, there is provided an in-wall valve assembly 10 for installation in a shower-bathtub combination. The valve assembly 10 includes a valve body manifold 12 with tapered PEX, (cross-linked polyethylene), nipples 20, 22, and 23 or copper or brass nipples 19, 21, and 27 including decreasing radius tips and/or an optional threaded nipple. The valve body manifold 12, shown in FIG. 3, also includes apertures 36 and 37 with threads for receiving and holding female sockets or water flow limiters 28. The two water flow limiters include an adjustable screw 18, a locking nut 16, a stopper 32, a spring 33, a sealing washer 38, and O-rings 35, 36. A central control cartridge receiving aperture 34 has external threads 65 and receives and holds a water flow cartridge (not shown and not included in the valve body) which is held in place by a cartridge locknut 26. The valve body manifold 12 also has a selected number of spacer means and/or alignment means comprising a plurality of lugs 40 of a selected thickness and area mounting to a rear surface of conduits extending from the sides of the valve body manifold. As shown in the figures, the valve body manifold 12 has an integral center base plate 92 having corners 61, 62, 63, and 64 with respective threaded apertures 43, 41, 45, 47, for affixing the housing 24 to the valve body manifold 12 mounting to a board 42 as shown in Figure. The lock nut protective sleeve cover 30 is removed after the valve body manifold 12 is installed.

Figure 3:
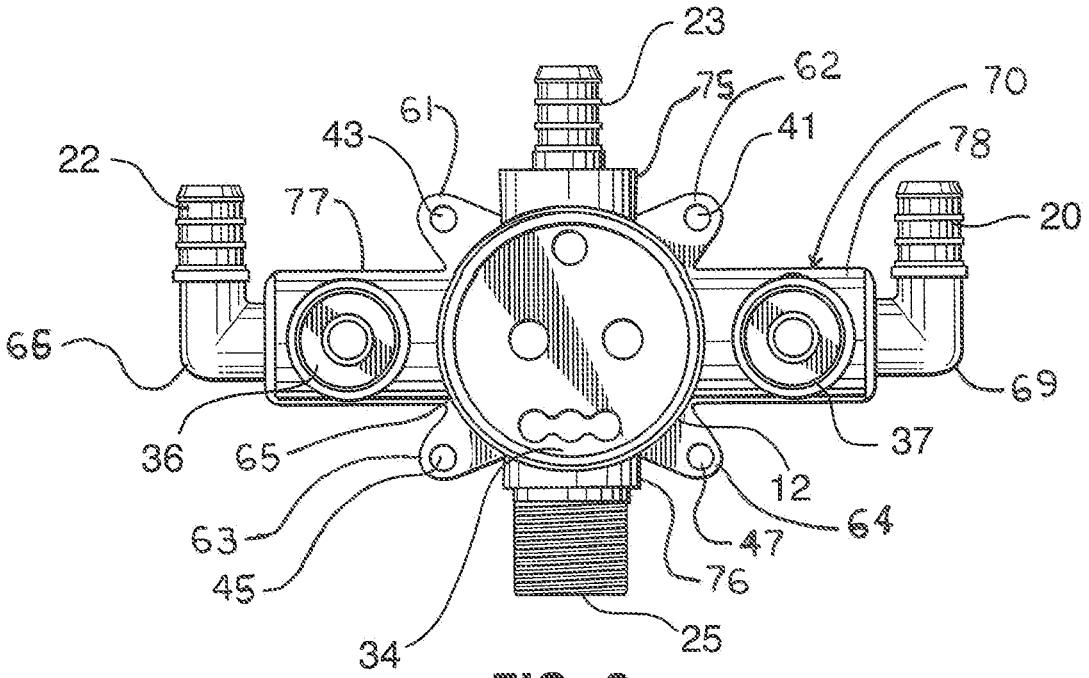
FIG. 3 is a front view of the valve body with PEX tubing connection nipples.

More particularly as shown in the FIG. 3, a combination shower and tub in-wall valve assembly 10 comprises or consists of an integral hollow valve body manifold 12 having a front surface 70 for flush fit to the finished wall, (not shown), and an adjoining rear surface 90. The valve body manifold 12 is affixable between a pair of wall studs 72, 73. The valve body manifold 12 has a vertical center conduit 74 defining a top conduit 75 and a bottom conduit 76, a first left side conduit 77, and a second right side conduit 78 extending from a center portion 79 of the vertical center conduit 74 normal thereto in fluid communication therewith.

As shown in FIG. 3, the first left side conduit 77 of the valve body manifold 12 includes a first rotatable elbow 66 having a first tapered side nipple 22 for connecting to a first water line input. The second right side conduit 78 includes a second rotatable elbow 69 having a second tapered side nipple 20 for connecting to a second water line input. The top conduit 75 includes a third tapered top nipple 23 for connecting to a shower water line output. The bottom conduit 76 includes a fourth threaded nipple 25 for cooperative engagement with a water line connecting to a tub spout water line 44 output.

Figure 2:
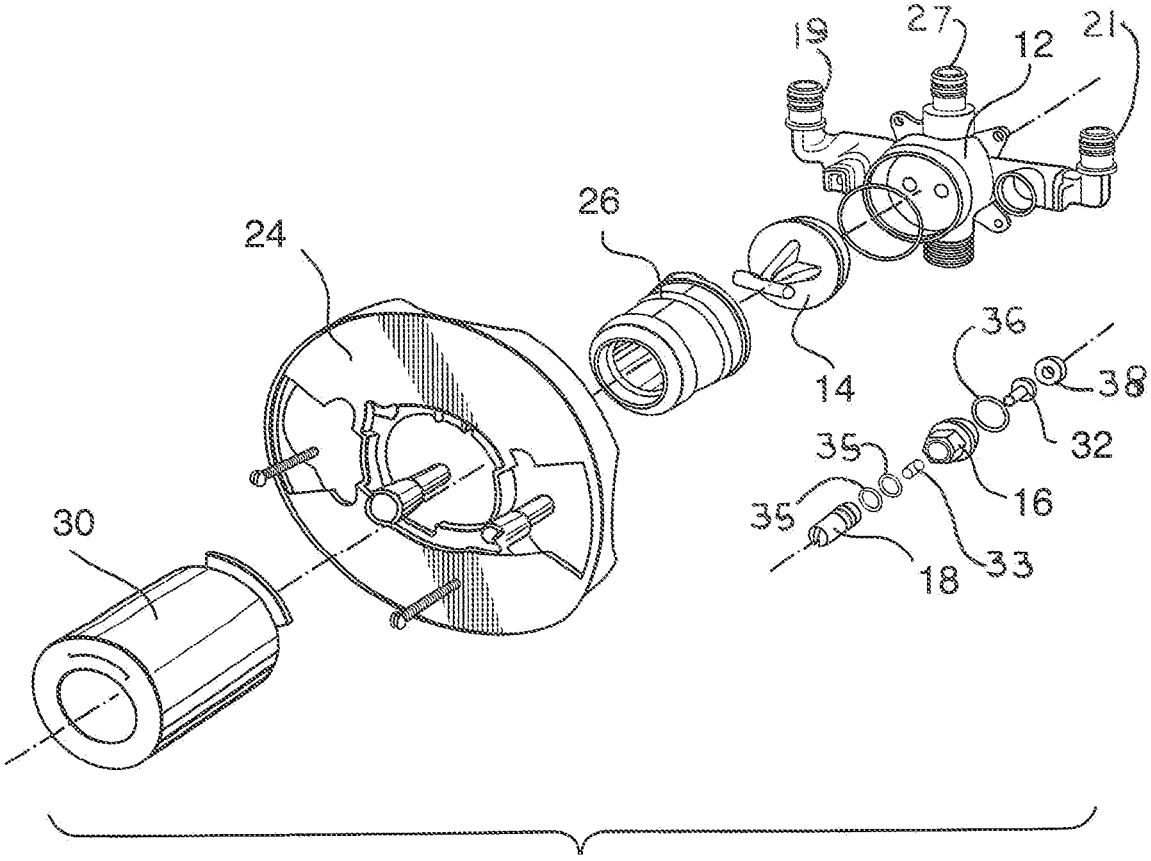
FIG. 2 is an illustrated parts list of the valve body.
Figure 4:
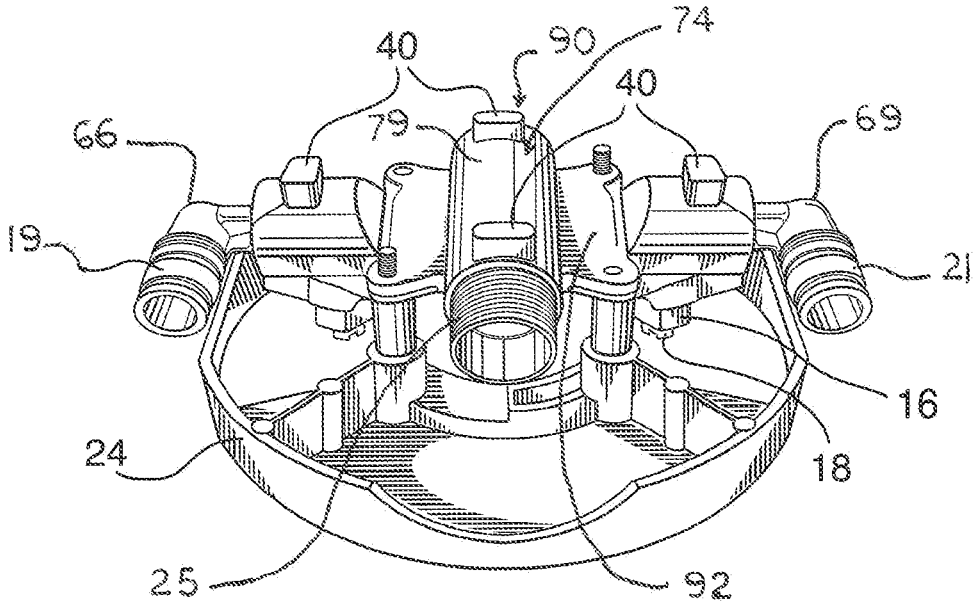
FIG. 4 is a rear perspective view of the valve body showing four standoffs on the rear side of the body.
Figure 5:
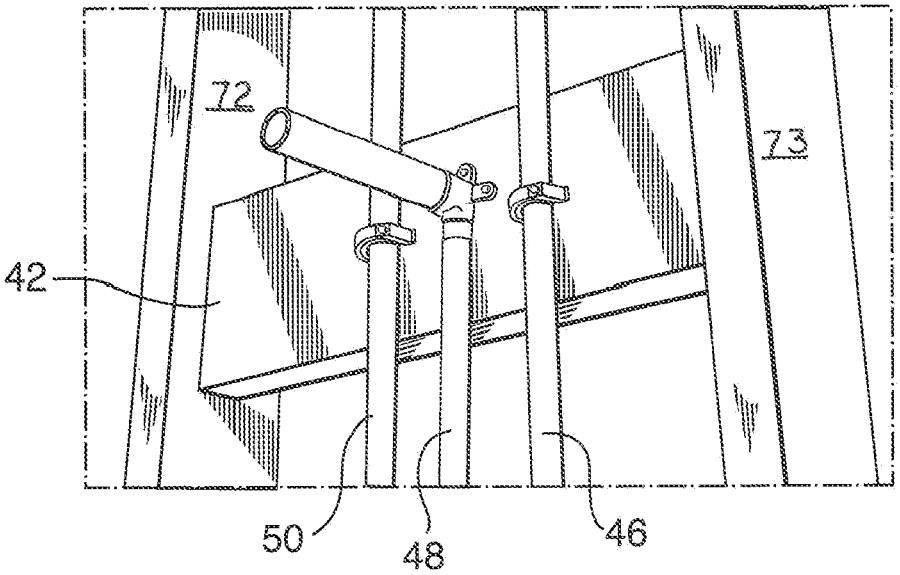
FIG. 5 is a front view of an installation of hot and cold water supply lines and shower feed lines connected to a board.
Figure 6:
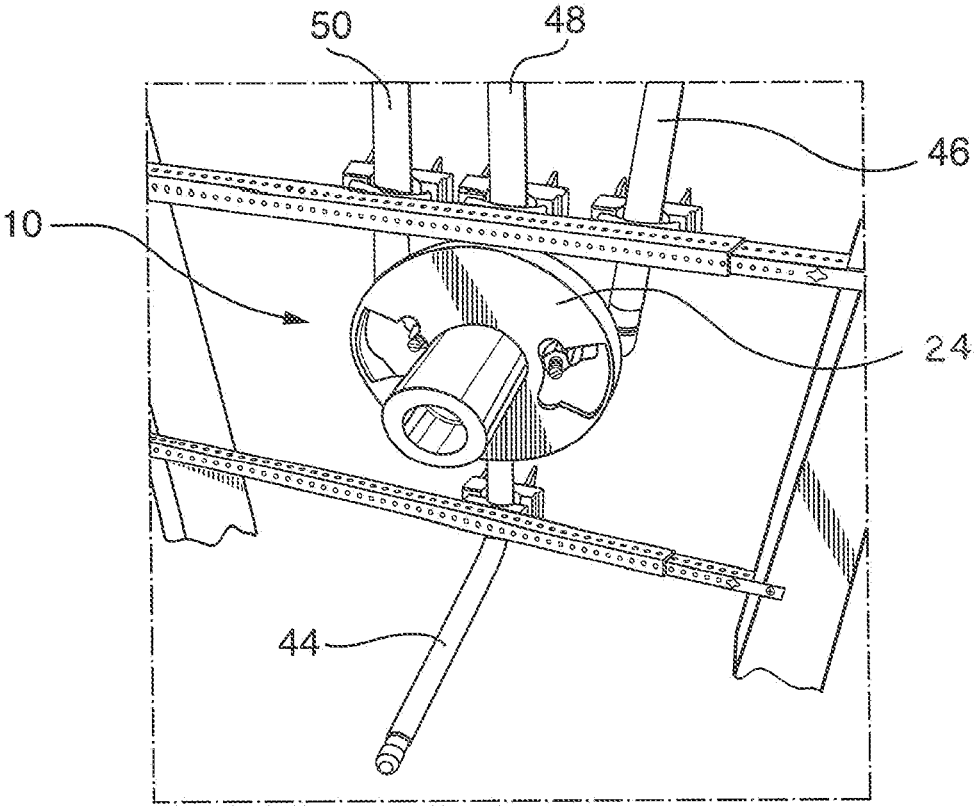
FIG. 6 is a front view of an installation of the valve body.
Figure 7:
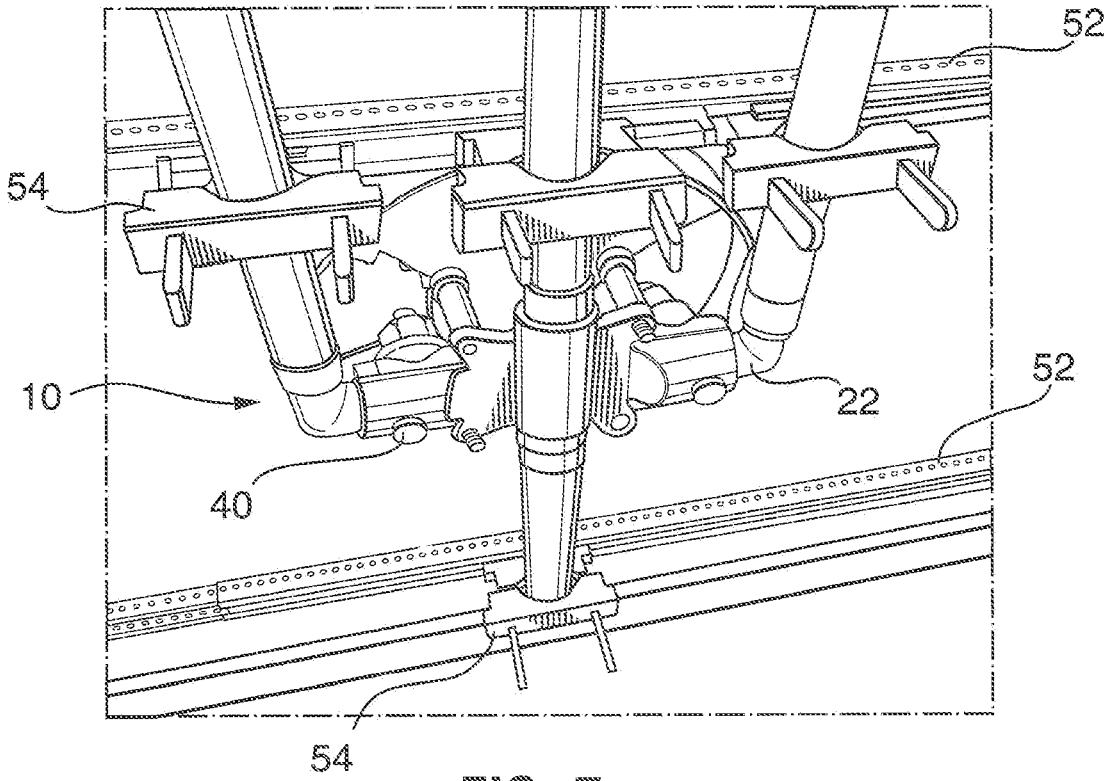
FIG. 7 is a rear view of an installation of the valve body.

As shown in FIGS. 2 and 4, the first left side conduit 77 of the valve body manifold 12 includes a brass or copper first tapered side nipple 19 for connecting to a first water line input. The second right side conduit 78 includes a brass or copper second tapered side nipple 21 for connecting to a second water line input. The top conduit 75 includes a brass or copper third tapered top nipple 27 for connecting to a shower water line 48 output.

The bottom conduit 76 includes a fourth threaded nipple 25 for cooperative engagement with a water line connecting to a tub spout water line 44 output. The valve body manifold 12 includes an adjustable flow limiter 28 for a first hot water line input and a second cold water line input extending from the front surface 70. The valve body manifold 12 includes a water controlling cartridge receiving aperture 34 formed therein with threads 65 for cooperatively engaging a cartridge locknut 26 capable of sealably fixing a water controlling cartridge 60 in place within the cartridge receiving aperture 34. The valve body manifold 12 includes spacer means defining a plurality of spaced apart opposing standoff lugs 40 of a selected area and equal thickness projecting from the rear surface 90 for providing for proper positioning of the rear surface 90 of the valve body manifold 12 with respect to a support such as a board 42 installed between the pair of wall studs 72, 73.

The valve body manifold 12 includes an integral center base plate 92 having a first corner 61 extending outwardly between the first tapered side nipple 19, 22 and the third tapered top nipple 23, 27. A second corner 62 extends outwardly between the third tapered top nipple 23, 27 and the second tapered side nipple 20, 21. A third corner 63 extends outwardly between the first tapered side nipple 19, 22 and the fourth threaded nipple 25. A fourth corner 64 extends between the second tapered side nipple 20, 21 and the fourth threaded nipple 25. The first corner 61, the second corner 62, the third corner 63, and the fourth corner 64 have threaded apertures 43, 41, 45, 47 respectively extending therethrough for cooperatively engaging a threaded member and holding the housing 24 to the valve body manifold 12.

The valve assembly 10 includes a temporary plug or pipe line stopper 14. After the valve body manifold 12 is installed and plumbed to the hot and cold water supply lines 46 and 50, water pressure may be applied to the lines for testing of the water supply line connections. After a successful test, the locking nut 26 may be removed and the test plug 14 may then be removed and discarded. A pressure balance control cartridge 60 may then be installed where the test plug had been located, when desired.

Figure 8:
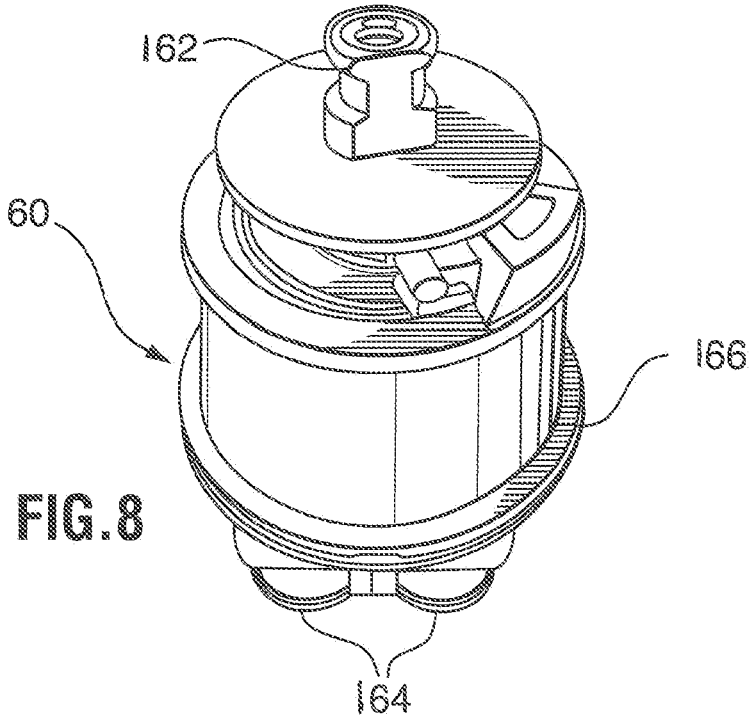
FIG. 8 is a front view of a pressure balanced water control cartridge.

FIG. 8 shows a pressure balanced water control cartridge 60 with a control stem 162 to which a knob or lever is applied for manual control. Apertures 164 at the bottom have O-rings which seal the bottom of the cartridge to the bottom of the cartridge aperture 34. The cartridge 60 is turned clockwise or counter clockwise to expose the apertures 164 to the holes in the bottom of the cartridge aperture 34 to either seal off the holes to water flow or to open the holes to water flow. The cartridge locking nut 26 slides over the top of the cartridge 60, and encounters the rim 166, thereby pushing the cartridge firmly into the cartridge receiving aperture as the locking nut 26 is threaded onto the valve body.

The faucet installation requires proper orientation of the valve. The word "UP" formed on the valve body should be point towards the shower riser and the word "DOWN" on the valve body should be pointed toward the tub spout outlet. The valve assembly is inserted with plaster guard into a hole cut in a wall. The flat surface marked "IMPORTANT" on the plaster guard should be flush with the finished wall surface. A ½ inch or larger copper line is required for the flow from the valve to the tub spout to prevent back pressure that will cause leakage from the shower head when discharging water through the tub spout. The down outlet is connected with the pipeline using TEFLON tape. Note that if the shower head or spout is not needed the washer is used to plug the "DOWN" valve hole or "UP" valve hole. The valve body is screwed into the wall.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

I claim:

1. A combination shower and tub in-wall valve assembly comprising:

a hollow valve body manifold having a front surface and having an adjoining rear surface, said valve body manifold mounting to a support affixed between a pair of wall studs;

said valve body manifold including an integrally formed vertical center conduit defining a top conduit and a bottom conduit, a first left side conduit, and a second right side conduit extending in the same plane from a center portion of said vertical center conduit and in fluid communication one another;

said first left side conduit of said valve body manifold including a first side nipple for connecting to a first water line input, said second right side conduit including a second side nipple for connecting to a second water line input, said top conduit including a third top nipple for connecting to a shower water line output and said bottom conduit including a fourth threaded nipple for cooperative engagement with a water line connecting to a tub spout water line output;

said valve body manifold including a first adjustable flow limiter for said first water line input and a second adjustable flow limiter for said second water line input;

said valve body manifold including an integrally formed water controlling cartridge receiving aperture formed therein defining a cylindrical member having threads on a distal end and a cartridge locknut capable of sealably fixing a water controlling cartridge in place within said water controlling cartridge receiving aperture, and said cartridge locknut cooperatively engaging said threads on said distal end of said cylindrical member;

said valve body manifold including integrally formed spacer means defining a plurality of spaced apart opposing standoff lugs of a selected area and equal thickness projecting from said rear surface for providing for proper positioning of said rear surface of said valve body manifold with respect to said support installed between said pair of wall studs;

said valve body manifold including an integrally formed center base plate having a first corner extending outwardly between said first side nipple and said third top nipple, a second corner extending outwardly between said third top nipple and said second side nipple, a third corner extending outwardly between said first side nipple and said fourth threaded nipple, a fourth corner extending between said second side nipple and said fourth threaded nipple; and said first corner, said second corner, said third corner, and said fourth corner having threaded apertures extending therethrough for cooperatively engaging a threaded member and holding a housing to said valve body manifold.

2. The combination shower and tub in-wall valve assembly of claim 1, further including a temporary removable pressure test plug held in place within said water controlling cartridge receiving aperture by said cartridge locknut for temporarily sealing a valve output during temporary pressure testing of an installed water supply line to said valve body manifold.

3. The combination shower and tub in-wall valve assembly of claim 1, said valve body manifold including a removable protective housing attaching to at least one of said four corners extending from said center base plate.

4. The combination shower and tub in-wall valve assembly of claim 1, said first left side conduit of said valve body manifold including a first rotatable elbow having said first side nipple for connecting to said first water line input, said second right side conduit including a second rotatable elbow having said second side nipple for connecting to said second water line input, said top conduit including said third top nipple for connecting to said shower water line output and said bottom conduit including said fourth threaded nipple for cooperative engagement with said water line connecting to said tub spout water line output.

5. The combination shower and tub in-wall valve assembly of claim 1, wherein said first left side nipple, said second right side nipple, and said third top nipple are tapered.

6. The combination shower and tub in-wall valve assembly of claim 1, wherein said in-wall valve assembly is composed from material selected from the group consisting of a cross-linked polyethylene material, a copper material, and a brass material.

7. The combination shower and tub in-wall valve assembly of claim 1, wherein said water controlling cartridge comprises a pressure balance control cartridge.

8. A combination shower and tub in-wall valve assembly comprising:

an integral hollow valve body manifold having a front surface and an adjoining rear surface, said valve body manifold affixable between a pair of wall studs;

said valve body manifold comprising a vertical center conduit defining a top conduit and a bottom conduit, a first left side conduit, and a second right side conduit extending outward in the same plane from a center portion of said vertical center conduit and in fluid communication with one another;

said first left side conduit of said valve body manifold including a first rotatable elbow having a first side nipple for connecting to a first water line input, said second right side conduit including a second rotatable elbow having a second side nipple for connecting to a second water line input, said top conduit including a top nipple for connecting to a shower water line output and said bottom conduit including a fourth threaded nipple for cooperative engagement with a water line connecting to a tub spout water line output;

said valve body manifold including a first adjustable flow limiter for said first water line input and a second adjustable flow limiter for said second water line input;

said valve body manifold including a water controlling cartridge receiving aperture formed therein defining a cylindrical member having threads on a distal end and a cartridge locknut capable of sealably fixing a water controlling cartridge in place within said water controlling cartridge receiving aperture, and said cartridge locknut cooperatively engaging said threads on said distal end of said cylindrical member;

said valve body manifold including spacer means defining a plurality of spaced apart opposing standoff lugs of a selected area and equal thickness projecting from said rear surface for providing for proper positioning of said rear surface of said valve body manifold with respect to a support installed between said pair of wall studs;

said valve body manifold including an integral center base plate having a first corner extending outwardly between said first side nipple and said top nipple, a second corner extending outwardly between said top nipple and said second side nipple, a third corner extending outwardly between said first side nipple and said fourth threaded nipple, a fourth corner extending between said second side nipple and said fourth threaded nipple; and said first corner, said second corner, said third corner, and said fourth corner having threaded apertures extending therethrough for cooperatively engaging a threaded member and holding a housing to said valve body manifold.

9. The combination shower and tub in-wall valve assembly of claim 8, wherein said first side nipple, said second side nipple, and said top nipple are tapered.

10. The combination shower and tub in-wall valve assembly of claim 8, wherein said water controlling cartridge comprises a pressure balance control cartridge.

11. A combination shower and tub in-wall valve assembly comprising:

a hollow valve body manifold having a front surface and having an adjoining rear surface, said valve body manifold mounting to a support extending between a pair of wall studs;

said valve body manifold including an integrally formed vertical center conduit defining a top conduit and a bottom conduit, a first left side conduit, and a second right side conduit extending in the same plane from a center portion of said vertical center conduit and in fluid communication one another;

said first left side conduit of said valve body manifold including a first side nipple for connecting to a first water line input, said second right side conduit including a second side nipple for connecting to a second water line input, said top conduit including a top nipple for connecting to a shower water line output and said bottom conduit including a fourth threaded nipple for cooperative engagement with a water line connecting to a tub spout water line output;

said valve body manifold including a first adjustable flow limiter for said first water line input and a second adjustable flow limiter for said second water line input;

said valve body manifold including an integrally formed water controlling cartridge receiving aperture formed therein defining a cylindrical member having threads on a distal end and a cartridge locknut capable of sealably fixing a water controlling cartridge in place within said cartridge receiving aperture and said cartridge locknut cooperatively engaging said threads on said distal end of said cylindrical member;

said valve body manifold including integrally formed spacer means defining a plurality of spaced apart opposing standoff lugs of a selected area and equal thickness projecting from a top portion, a bottom portion, a left side portion and a right side portion of said rear surface of said valve body manifold for providing for proper positioning of said rear surface of said valve body manifold with respect to said support installed between said pair of wall studs;

said valve body manifold including an integrally formed center base plate having a first corner extending outwardly between said first side nipple and said top nipple, a second corner extending outwardly between said top nipple and said second side nipple, a third corner extending outwardly between said first side nipple and said fourth threaded nipple, a fourth corner extending between said second side nipple and said fourth threaded nipple; and said first corner, said second corner, said third corner, and said fourth corner having threaded apertures extending therethrough for cooperatively engaging a threaded member and holding a housing to said valve body manifold.

12. The combination shower and tub in-wall valve assembly of claim 11, said in-wall valve assembly comprising a cross-linked polyethylene.

13. The combination shower and tub in-wall valve assembly of claim 11, said in-wall valve assembly comprising copper.

14. The combination shower and tub in-wall valve assembly of claim 11, said in-wall valve assembly comprising brass.

15. The combination shower and tub in-wall valve assembly of claim 11, wherein said first side nipple, said second side nipple, and said top nipple are tapered.

* * * * *